US005984305A

United States Patent [19]

Inoue

[11] Patent Number: 5,984,305

[45] Date of Patent: Nov. 16, 1999

[54] IMAGE FORMING APPARATUS HAVING RELEASABLE SHEET CONVEYING PATHS AND METHOD OF USE

[75] Inventor: Nobuo Inoue, Ichikawa, Japan

[73] Assignee: Ricoh Company, Ltd., Tokyo, Japan

[21] Appl. No.: 09/069,292

[22] Filed: Apr. 29, 1998

[30] Foreign Application Priority Data

May 15, 1997 [JP] Japan ..... 9-125689

[51] Int. Cl.[6] ..... B65H 39/10

[52] U.S. Cl. ..... 271/291; 271/301; 271/65; 271/186; 271/902; 271/273

[58] Field of Search ..... 271/291, 301, 271/65, 186, 902, 273, 274; 399/124, 364, 401

[56] References Cited

U.S. PATENT DOCUMENTS 4,814,825 3/1989 Johdai et al. ..... 271/65
5,293,203 3/1994 Wada et al. ..... 271/301 X
5,337,134 8/1994 Sato et al. ..... 271/291 X
5,865,547 2/1999 Harris et al. ..... 271/291 X

FOREIGN PATENT DOCUMENTS 63-178845 11/1988 Japan .
63-306463 12/1988 Japan .
64-4758 1/1989 Japan .

*Primary Examiner*—David H. Bollinger
*Attorney, Agent, or Firm*—Oblon, Spivak, McClelland, Maier & Neustadt, P.C.

[57] ABSTRACT

An image forming apparatus has a plurality of parallel mounted sheet conveying paths including at least two guide plates swingable between a sheet guiding position in which the plates guide a sheet, and a jammed sheet removing position in which the sheet conveying path is opened. The image forming apparatus further includes an opening and shutting mechanism for moving the swingable guide plates between the sheet guiding position and the jammed sheet removing position.

11 Claims, 7 Drawing Sheets

IMAGE FORMING APPARATUS HAVING RELEASABLE SHEET CONVEYING PATHS AND METHOD OF USE

RELATED ART OF THE INVENTION

1. Field of the Invention

The present invention relates to an image forming apparatus and method, such as a printer, a copying machine, a facsimile machine and the like, and in particular, to an image forming apparatus having a plurality of parallel mounted sheet conveying paths that are formed with a plurality of sheet guide members.

2. Discussion of the Background

In an image forming apparatus such as a copying machine, the occurrence of sheet jamming cannot be completely avoided. Therefore the image forming apparatus must be constructed so that a user can easily remove a jammed sheet anywhere in a sheet conveying path of the image forming apparatus. Accordingly, improvements in the ability to remove easily the jammed sheet are highly desired. Responding to such a desire, in the image forming apparatus disclosed in, for example, Japanese Laid-Open Patent Publication No. 4-125248/1992, a first lever mechanism is mounted so that a conveying path opens and shuts together with opening and shutting operations of a first exterior cover, and a second lever mechanism opens and shuts a second exterior cover, mounted at an angle to the first cover, together with opening and shutting operations of the first exterior cover. In this image forming apparatus, a sheet conveying path can be opened by opening the exterior cover, and the jammed sheet can easily be removed.

However, in the image forming apparatus described in the Japanese Laid-Open Patent Publication No. 4-125248, since a guide plate that is opened is heavy, a torsion spring must be used in order to support the cover. Accordingly, a complex mechanism is required and the manufacturing cost is increased. Further, in this image forming apparatus, a plurality of parallel mounted sheet conveying paths cannot be opened.

To solve the above-mentioned problem, the present applicant had previously proposed a sheet conveying apparatus that can simultaneously open a plurality of parallel mounted sheet conveying paths along with the opening and shutting operations of the exterior cover. In this apparatus, a swingable guide plate is opened and shut by a pressing projection fixed inside of the exterior cover. The pressing projection is long and large enough to have sufficient size and strength to be inserted inside the sheet conveying apparatus. Therefore, the exterior cover must be opened wide enough that the pressing projection is out of the way and will not disturb an operation of removing the jammed sheet, resulting in a space problem. Further, the sharp tip of the pressing projection can break parts or cause a hand injury, and if the position of the pressing projection is offset, it can damage or deform the guide plate, which can cause sheet jamming.

SUMMARY OF THE INVENTION

It is therefore an object of the present invention to provide an image forming apparatus capable of opening a plurality of parallel mounted sheet conveying paths with a simple operation for removing a jammed sheet.

According to one aspect of the present invention, the above and other objects are achieved by an image forming apparatus having a plurality of parallel mounted sheet conveying paths, comprising an image forming portion which transfers an image to a sheet; a movable reverse unit, positioned adjacent the sheet conveying paths, for reversing a direction of movement of a sheet; at least two swingable guide members defining the plurality of parallel mounted sheet conveying paths and swingably mounted for movement between a sheet guide position in which said swingable guiding members are able to guide a sheet along said sheet conveying paths, and a jammed sheet removing position in which said sheet conveying paths are opened and accessible for removal of a jammed sheet; and an opening and shutting mechanism operative for causing said swingable guide members to move between the sheet guide position and the jammed sheet removing position, wherein said opening and shutting mechanism is operated responsive to a movement of the reverse unit.

The image forming apparatus further includes an opening and shutting mechanism for moving the swingable guide members between the sheet guiding position and the jammed sheet removing position. The opening and shutting mechanism is operated by a movement of the reverse unit.

The opening and shutting mechanism includes a swingable member mounted on a rotating shaft and a pressing member for contacting one of the swingable guide members, fixed on the rotating shaft, in which a pressing device for pressing the swingable member is mounted on the reverse unit. The swingable guide members are held at a guiding position when the pressing member is pressed by the pressing device, and are at a jammed sheet removing position when the pressing device releases the pressure. The swingable member is mounted at an approximately central position in the longitudinal direction of the rotating shaft.

The reverse unit is slidably mounted on a main body of the image forming apparatus, and the pressure of the swingable member by the pressing device is released by any movement of the reverse unit from a fully installed position in the main body.

At least one roller pair is mounted on the swingable guide members so as to form a nip when the swingable guide members are in the sheet guide position for advancing a sheet through one of said sheet conveying paths. The pressure at the nip is released when the swingable guide members are in the jammed sheet removing position so as to permit removal of a jammed sheet.

BRIEF DESCRIPTION OF THE DRAWINGS

A more complete appreciation of the invention and the attendant advantages thereof will be readily obtained by referring to the following detailed description when considered in connection with the accompanying drawings, wherein.

DESCRIPTION OF THE PREFERRED EMBODIMENT

An embodiment of the present invention applied to an image forming apparatus is explained hereinafter by referring to the accompanying drawings.

Figure 1:
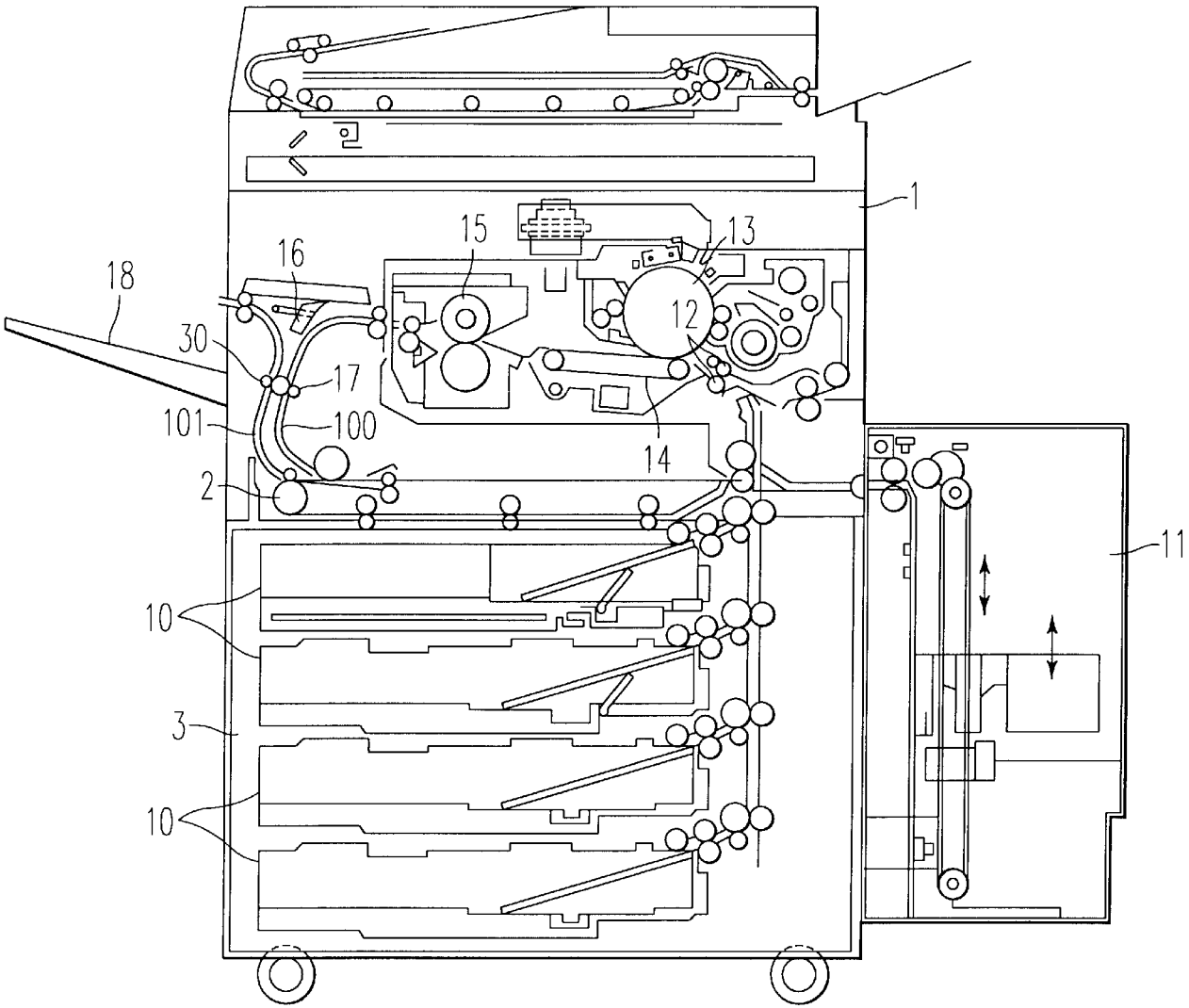
FIG. 1 is a schematic illustration of a copying machine as an image forming apparatus of the present invention.

FIG. 1 is a cross sectional view showing a digital copying machine as an image forming apparatus of the present invention. In this copying machine, transfer sheets are stacked in sheet feeding trays 10 of a sheet feeding device mounted at a lower part of a main body of the image forming apparatus 1 or a large capacity sheet feeding tray 11 mounted at a side part of the image forming apparatus 1. A sheet feeding path for conveying the sheets is explained hereinafter. A sheet fed from a sheet feeding tray 10 or the large capacity sheet feeding tray 11 is conveyed to a registration rollers pair 12 and further conveyed to a photoconductive element 13 as an image bearing member which is controlled with a predetermined conveying timing via the registration rollers pair 12. A toner image is transferred to the sheet at a transfer device 14. The sheet is then conveyed to a fixing device 15 and the transferred image is fixed on the sheet. The sheet having the toner image fixed thereon is usually discharged to a sheet discharging tray 18 via a selecting part on which reverse selecting picks 16 are mounted. However, when a duplicating mode or a reverse discharging mode is selected, the reverse selecting picks 16 are held at a position indicated by a broken line in FIG. 2. Accordingly, the sheet is conveyed to a reversing unit 2 by the reverse selecting picks 16, via a reversing path 100 provided with an internal conveying roller 17.

Figure 2:
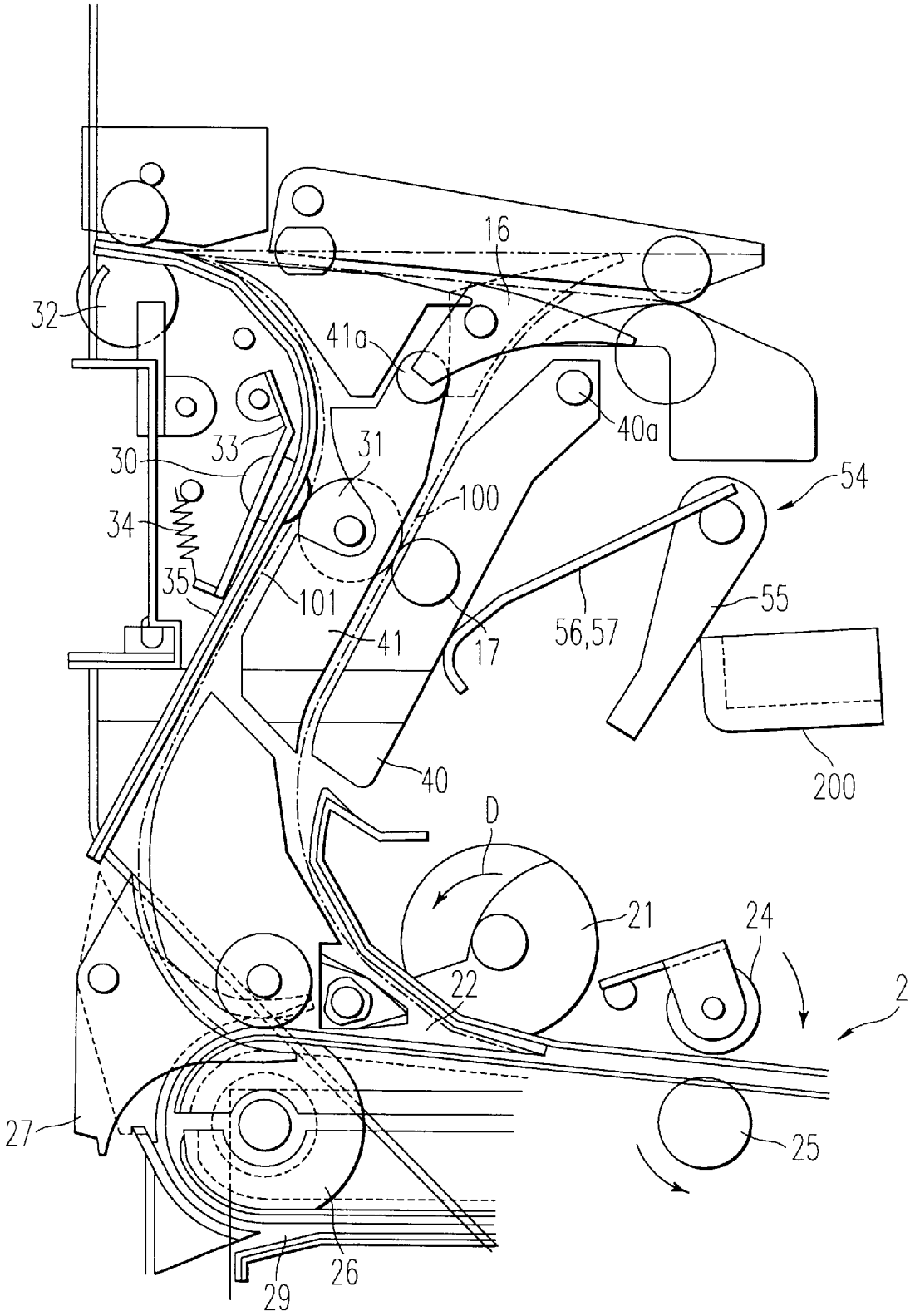
FIG. 2 is a detailed cross sectional view of a discharging section and a reversing section of the copying machine shown in FIG. 1.
Figure 4:
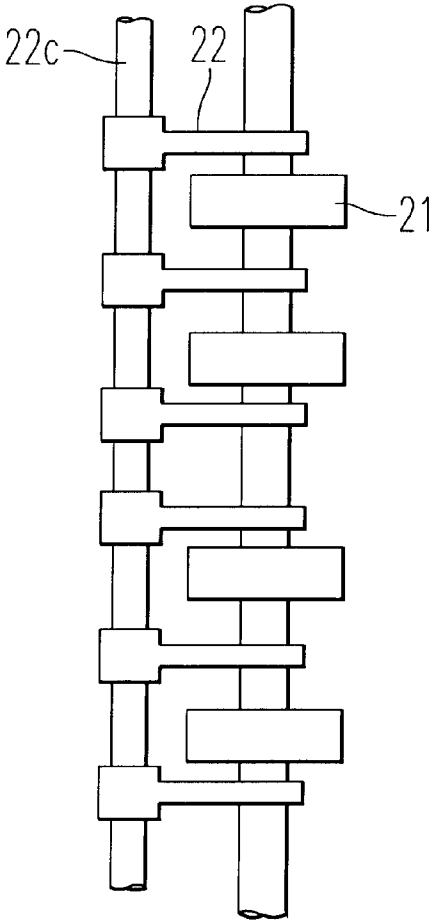
FIG. 4 is a schematic illustration of a selecting pick and a reversing roller unit in FIG. 3, looking from underneath.
Figure 3:
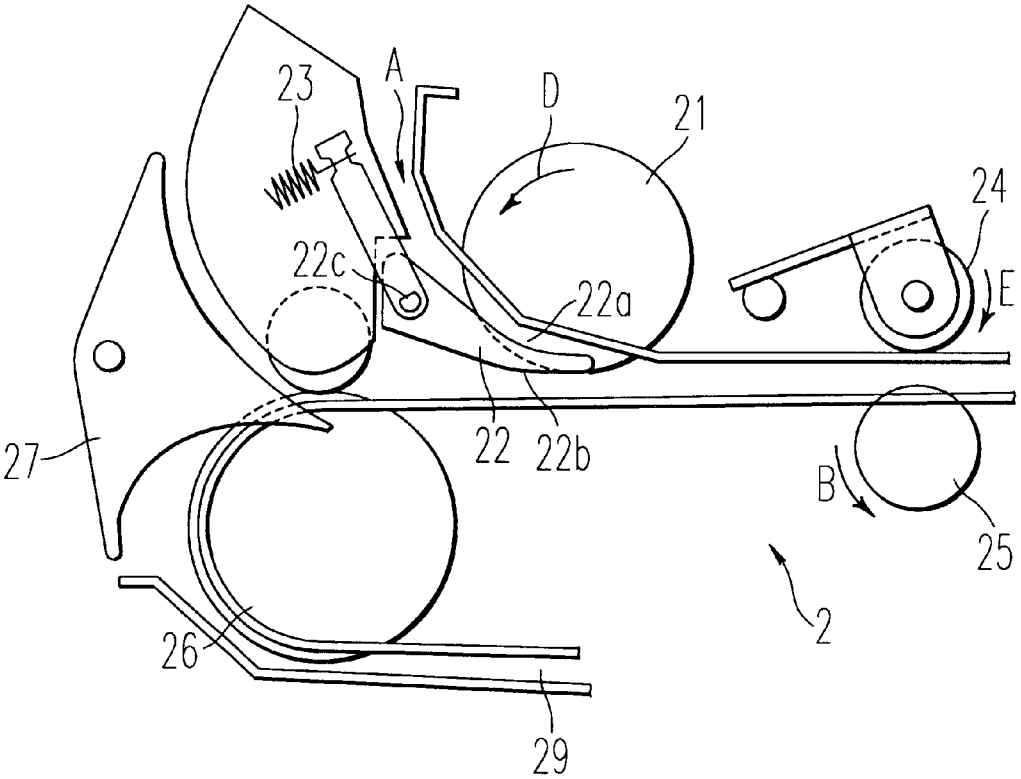
FIG. 3 is a detailed cross sectional view of the reversing section of the copying machine shown in FIG. 1.

In the reversing unit 2 as shown in FIGS. 2 through 4, selecting picks 22 swingably held on a shaft 22*c* in FIG. 3 are located between respective rollers of a reversing roller unit 21 composed of a shaft supporting a plurality of equally spaced rollers continuously rotating in a direction indicated by an arrow D, which is the same direction as the sheet conveying direction. The selecting picks 22 are biased by an elastic member 23 so that the curving face part 22*a* that faces the reversing roller 21 unit encroaches between the rollers thereof; the closer to the tip end of the selecting pick 22, the deeper the curving face part 22*a* encroaches.

When the sheet is conveyed along the arrow direction A to a space between the reversing roller unit 21 and the selecting picks 22, the selecting picks 22 are rotated against an action of the elastic member 23 by an advancing force of the sheet. Furthermore, when the trailing edge of the sheet passes the selecting picks 22 by being conveyed by an advancing force of the selecting picks 22 and the reversing roller unit 21, a switchback following roller 24 rotates in a direction indicated by an arrow E, and the sheet is nipped between the switchback following roller 24 and a switchback roller 25 which is continuously rotated in a direction indicated by an arrow B, so that the direction of movement of the sheet is reversed and the trailing edge of the sheet becomes a leading edge. At that time, since the selecting pick 22 is returned to the encroaching position of FIG. 3, the sheet is guided by a back side 22*b* of the selecting pick 22. Thus, as seen in FIG. 2, the sheet passes through either a reverse discharging path 101 or a duplication re-feeding path 29 according to a switching direction of the duplication selecting pick 27. Namely, when reverse discharging for page arrangement is selected, the duplication selecting pick 27 moves down to the solid line position in FIG. 2, and the sheet is discharged out of the image forming apparatus through the reverse discharging path 101, an outer discharging roller 30 and a discharging exit roller 32. Conversely, when a duplication copying mode is selected, the sheet is refed through the duplication refeeding path 29 by moving the duplication selecting pick 27 up to the position indicated by a broken line in FIG. 2.

Since a reverse path 100 and the reverse discharging path 101 are provided at a discharging section in this copying machine, there is a possibility of a sheet jamming therein. Accordingly, the copying machine in this embodiment is constructed so that an operator can easily remove a sheet that is jammed at the reverse path 100 or the reverse discharging path 101. Namely, the reverse path 100 is formed by a rightward swingable guide plate 40 swingably mounted on a shaft 40*a* at its upper side, and a leftward swingable guide plate 41 swingably mounted on a shaft 41*a* at its upper side, and the reverse discharging path 101 is formed by the leftward swingable guide plate 41 and a discharging guide plate 35. Further, the internal conveying roller 17 is supported by the rightward swingable guide plate 40 at a middle area of the reverse path 100 as part of a conveying roller pair including a drive roller 31 in the reverse path 100, and another conveying roller pair is provided at the reverse discharging path 101 and is composed of the drive roller 31 and the outer discharging roller 30 supported by a discharging roller bracket 33 at a middle area of the reverse discharging path 101.

The rightward swingable guide plate 40 and the leftward swingable guide plate 41 are supported by a swingable guide plate open and shut mechanism 54 so as to be in a guiding position, shown in FIG. 2, in which the swingable guide plates 40 and 41 are inclined in a direction rotated clockwise in comparison with a position in which the swingable guide plates 40 and 41 hang down, by gravity, from the shafts 40*a* and 41*a* as respective swinging centers.

Figure 5:
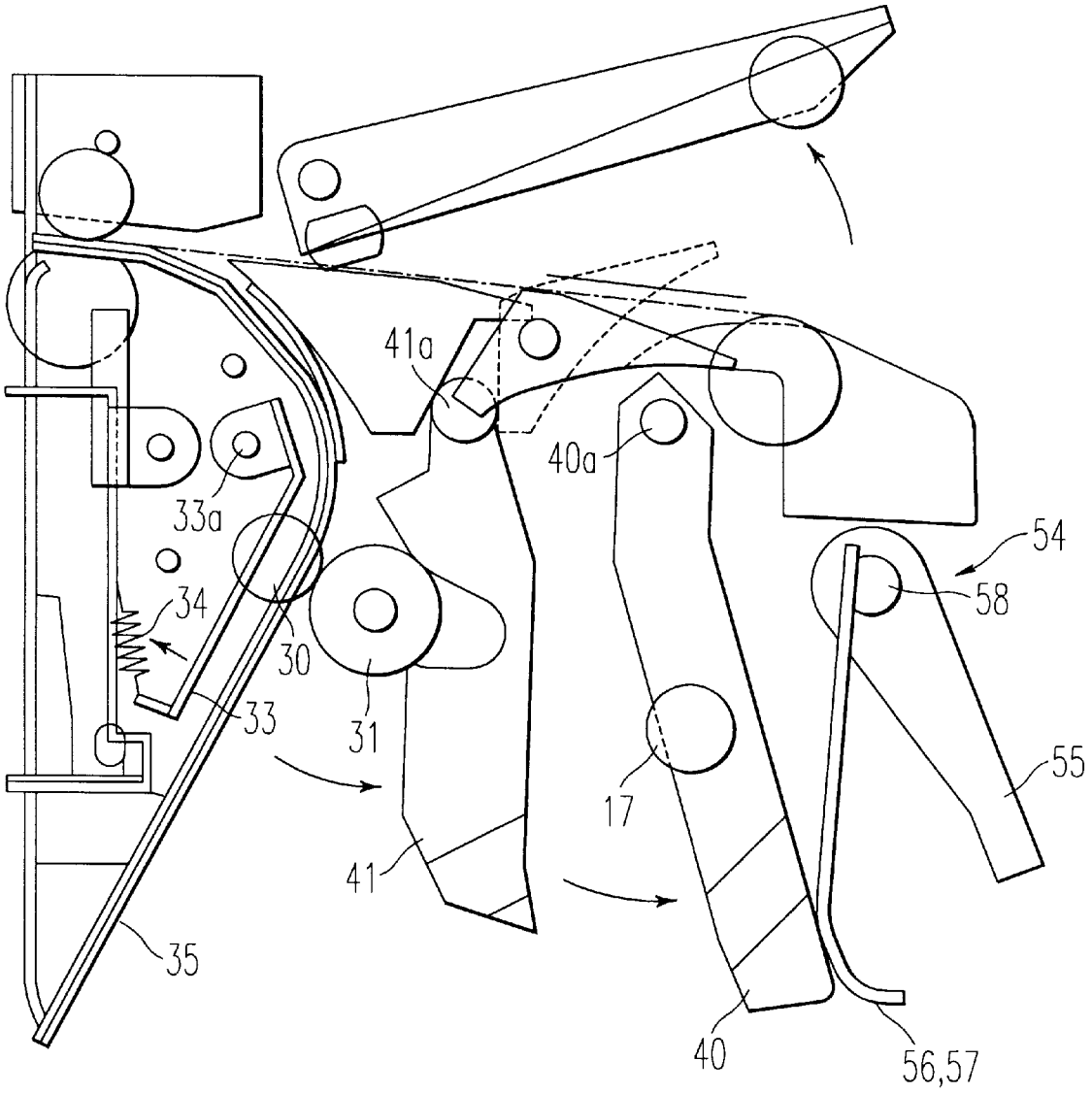
FIG. 5 is an illustration showing a state of a rightward swingable guide plate and a leftward swingable guide plate when a jammed sheet is removed at a discharging unit.
Figure 8:
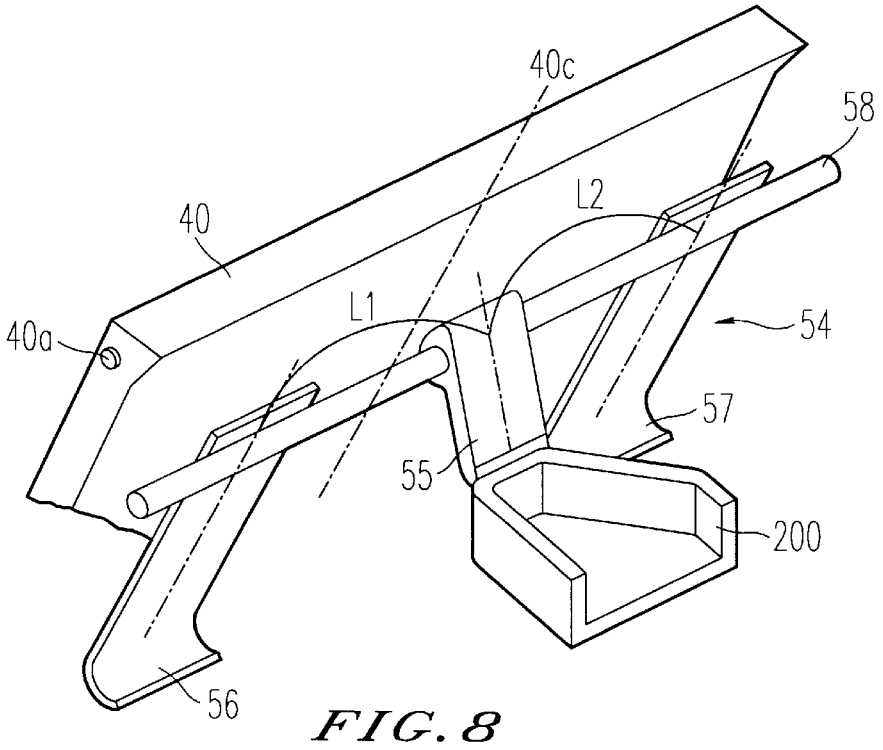
FIG. 8 is a schematic perspective view of a swingable guide plate open and shut mechanism.

The swingable guide plate open and shut mechanism 54 is composed of a swingable lever 55 that receives a pressing cam 200 (see FIG. 6) as a pressing device mounted on the reverse unit 2, and is fixed on a rotation shaft 58 as shown in FIG. 8, and pressing arms 56 and 57 that push the rightward swingable guide plate 40 in a leftward direction are fixed on the same rotation shaft 58 in FIG. 5. The pressing arms 56 and 57 may be composed of a leaf spring or a similar elastic member. Further, when the reverse unit 2 is set at a proper, fully installed position within the main body, the swingable lever 55 is pushed by the pressing cam 200 to rotate the rotation shaft 58 clockwise, and the rightward swingable guide plate 40 and the leftward swingable guide plate 41 are supported at the guiding position shown in FIG. 2 by the pressing arms 56 and 57 that press the rightward swingable guide plate 40 leftward.

Figure 7:
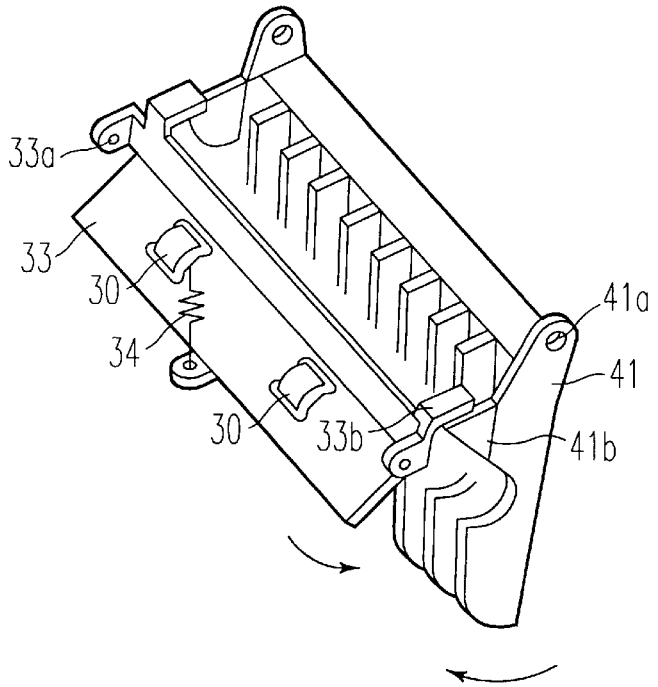
FIG. 7 is a schematic perspective view showing a relationship among a leftward swingable guide plate, an outer discharging roller and a bracket.

In FIG. 7, the outer discharging roller 30 is shown mounted on the discharging roller bracket 33 which is swingably mounted at a side plate (not shown) around rotation shaft supporting parts 33*a* as a swinging center. An elastic member 34 such as an extension spring or the like is mounted at the discharging roller bracket 33 and thereby biases the outer discharging roller 30 so as to separate from the drive roller 31 in FIG. 5. Further, a pressing member 41*b* in FIG. 7 is mounted at each end of the leftward swingable guide plate 41. The pressing members 41*b* can push up pressing arms 33*b* mounted on both ends of the discharging roller bracket 33 and make the outer discharging roller 30 contact the drive roller 31 of FIG. 5 against the force of the elastic member 34.

Figure 6:
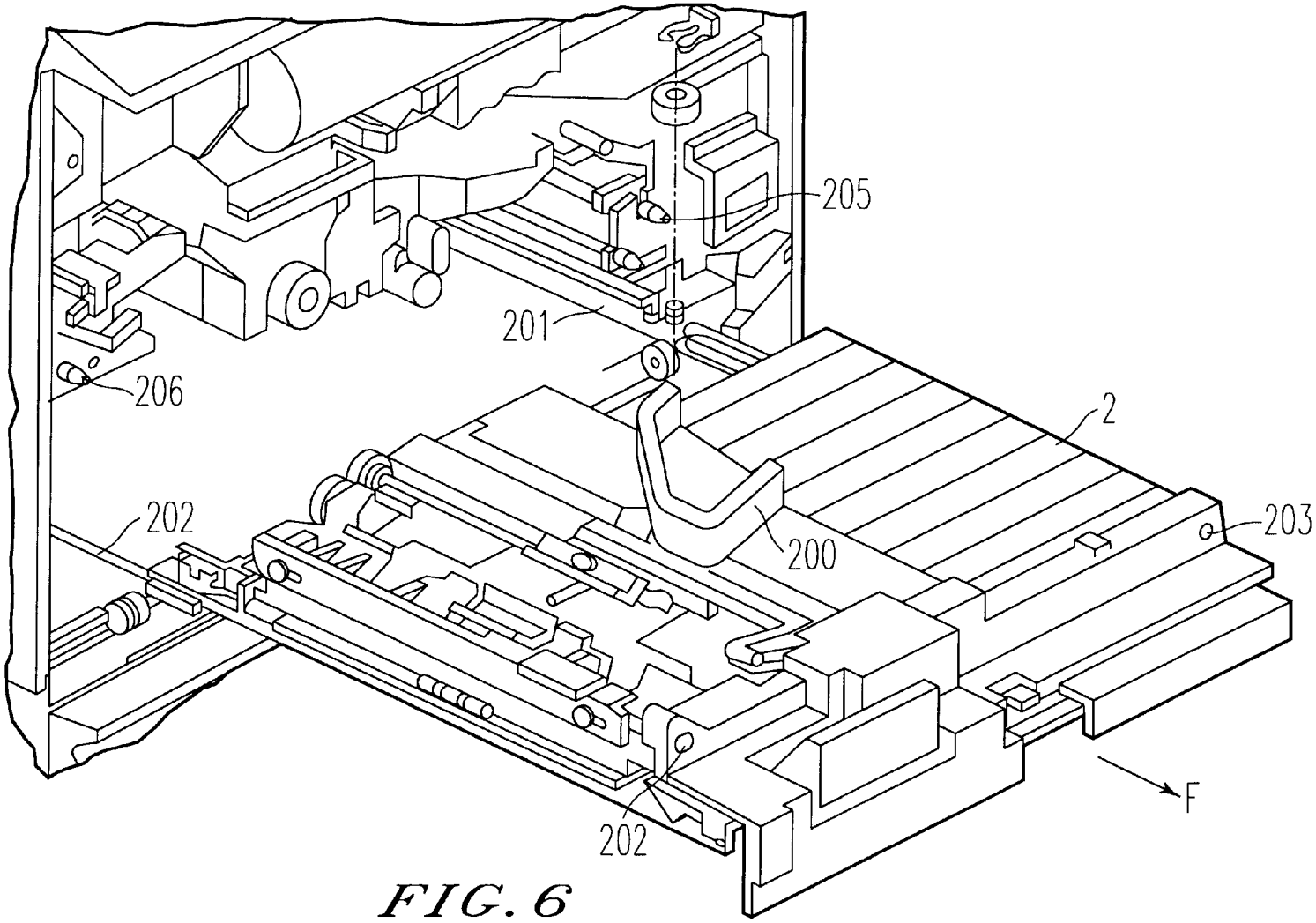
FIG. 6 is a schematic perspective view of the copying machine when pulling out a reversing unit.

As shown in FIG. 6, the reverse unit 2 is slidably mounted on rightward and leftward guide rails 201 and 202 mounted on a main body of the image forming apparatus, and when the reverse unit 2 is set at a proper position of the main body of the apparatus, positioning pins 205 and 206 on the main body of the apparatus fit into positioning holes 203 and 204. Thereby an accurate positioning of the reverse unit 2 at a proper position thereof can be assured. Further, the pressing cam 200 is fixed on an approximately central part in a transverse direction at an upper side of the reverse unit 2. Accordingly, when the reverse unit 2 is set at a proper position in FIG. 2, the swingable lever 55 that is pressed by the pressing cam 200 is also mounted on an approximately central part in the transverse direction.

In the copying machine thus constructed, if sheet jamming has occurred in the reverse path 100 or the reverse discharging path 101, a sheet jam detecting device (not shown) detects this sheet jamming and a controller stops operation of the apparatus. Then the controller reports the sheet jam to an operator. Hereupon, the operator removes the jammed sheet by opening an outer cover (not shown) at a front side, and then pulling out the reverse unit 2 in a direction indicated by an arrow F shown in FIG. 6.

When the reverse unit 2 is moved in the direction indicated by an arrow F, the swingable guide plate open and shut mechanism 54 in FIG. 8 becomes free to move since the pressing cam 200 moves out from the swingable lever 55. Then the rightward swingable guide plate 40 and the leftward swingable guide plate 41 of FIG. 7 move to a sheet jam removing position shown in FIG. 5, where the rightward swingable guide plate 40 and the leftward swingable guide plate 41 hang down from the shafts 40*a* and 41*a* as swinging centers respectively by gravity, since the pressure of the pressing arms 56 and 57 is released. At this time, the internal conveying roller 17 that is supported by the rightward swingable guide plate 40 is separated from the drive roller 31 due to the movement of the rightward swingable guide plate 40 towards the sheet jam removing position. Further, when the leftward swingable guide plate 41 has moved towards the sheet jam removing position, the pressing member 41*b* of FIG. 7 in the leftward swingable guide plate 41 is separated from the pressing arm 33*b*. Then the discharging roller bracket 33 is rotated clockwise around the shaft supporting parts 33*a* as a rotation center by the action of the elastic member 34, and the outer discharging rollers 30 that are supported by the discharging roller bracket 33 are separated from the drive roller 31 of FIG. 5.

When the reverse unit 2 of FIG. 6 is thus moved in the direction indicated by the arrow F, the rightward swingable guide plate 40 and the leftward swingable guide plate 41 in FIG. 2 move to the sheet jam removing position from the guiding position, and the reverse path 100 and reverse discharging path 101 are opened. Further, since pressure at the nips between the pairs of conveying rollers is released, the jammed sheet can be easily removed. For reference, if only the reverse path 100 and the reverse discharging path 101 were to be opened, the jammed sheet may be torn by the pressure at the nips of the conveying rollers pairs when the jammed sheet is pulled out. The construction of the present embodiment can surely avoid such a problem.

On the other hand, the rightward swingable guide plate 40 and the leftward swingable guide plate 41 must be wide enough to guide the maximum size sheet that is used in the apparatus. Accordingly, if the pressure for keeping the rightward swingable guide plate 40 and the leftward swingable guide plate 41 at the guiding position is inclined to one side, a sheet skew may occur.

To solve this problem, in the present embodiment the swingable lever 55 is fixed on the rotation shaft 58 at a position approximately aligned with a sheet conveying center 40*c* (FIG. 8), and the pressing arms 56 and 57 of the same shape are mounted at positions approximately equally spaced from the sheet conveying center 40*c* (L1=L2).

In the thus constructed image forming apparatus, a twist of the rotation shaft 58 can be avoided since the pressure of the pressing cam 200 is applied at a center of the rotation shaft 58 via the swingable lever 55. Further, since the rightward swingable guide plate 40 is pressed with the pressing arms 56 and 57 symmetrically mounted about the sheet conveying center 40*c*, both the front side and the rear side of the apparatus can be evenly pressed. Therefore, sheet conveying skew due to unevenness of the pressure to the front side and the rear side of the rightward swingable guide plate 40 can be surely prevented.

Figure 9:
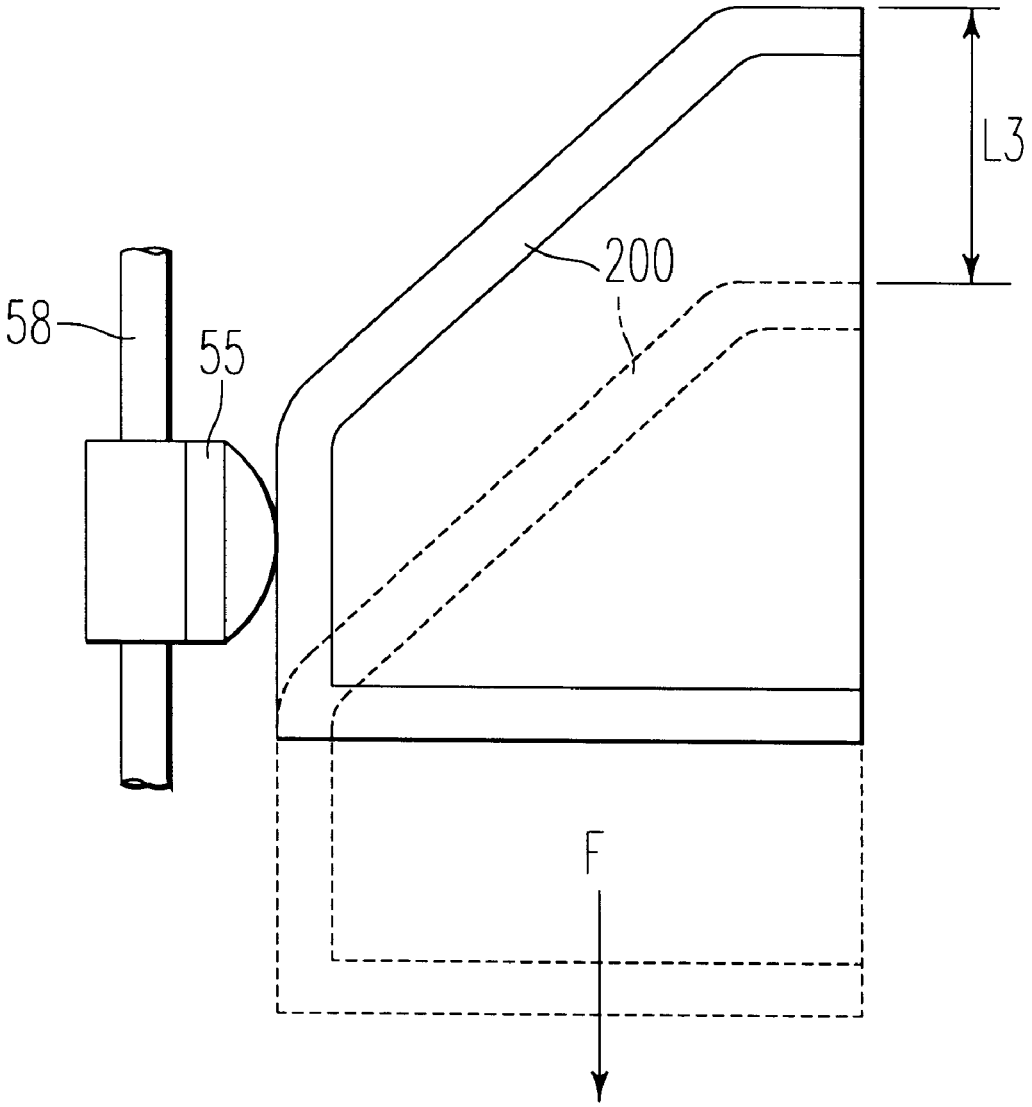
FIG. 9 is a schematic top plan view of the swingable guide plate open and shut mechanism in FIG. 8.

Further, in FIG. 2 there is a high possibility that the jammed sheet extends beyond the reverse path 100 into the reverse unit 2, or beyond the reverse discharging path 101 into the reverse unit 2. In this situation, if the reverse unit 2 is pulled out so as to open the reverse path 100 and the reverse discharging path 101, the jammed sheet is torn off when one end of the jammed sheet is pulled by the movement of the reverse unit 2 before another end of the jammed sheet has been released from the reverse path 100 or the reverse discharging path 101. Accordingly, a moving distance L3 of the pressing cam 200 from a pressing position to a pressure-releasing position, as shown in FIG. 9, is set to be small. Consequently, the jammed sheet can be prevented from being torn off or broken due to being pulled by the movement of the reverse unit in the direction indicated by the arrow F when the moving distance L3 is set to be small. For reference, when the moving distance L3 of the pressing cam 200 is set to be 30 mm or less, the jammed sheet is prevented from being torn and broken.

The preferred embodiment of the present invention is explained above. In the embodiment shown in FIG. 2, for example, the reverse path 100 and the reverse discharging path 101 are constructed to open and shut by moving the reverse unit 2 mounted at a downstream side of the reverse path and the reverse discharging path. However, the reverse path and the reverse discharging path could instead be constructed to open and shut by moving the fixing unit located at an upstream side of the reverse path and the reverse discharging path, with a similar effect.

Furthermore, even though the swingable guide plates 40 and 41 are constructed to open and shut the reverse path and the reverse discharging path due to the weight of the swingable guide plates, an elastic force of a spring can instead be employed to open the swingable guide plates when the pressure thereto is released. A reverse path and a reverse discharging path that are not inclined then become capable of being opened and shut.

Having now fully described the invention, it will be apparent to one of ordinary skill in the art that many changes and modifications can be made thereto without departing from the spirit and scope of the invention as set forth herein.

This application is based on Japanese Patent Application No. 09-125689, filed on May 15, 1997, the entire contents of which are herein incorporated by reference.

What is claimed as new and desired to be secured by letters patent ot the united states is:

1. An image forming apparatus having a plurality of parallel mounted sheet conveying paths, comprising:

an image forming portion which transfers an image to a sheet and which carries a plurality of shafts;

a movable reverse unit, positioned adjacent the sheet conveying paths, for reversing a direction of movement of the sheet;

at least two swingable guide plates, swingably mounted on said shafts for movement between a sheet guide position in which said swingable guide plates are able to guide the sheet along said sheet conveying paths, and a jammed sheet removing position in which said sheet conveying paths are opened and accessible for removal of a jammed sheet; and an opening and shutting mechanism for causing said swingable guide plates to move about said shafts between the sheet guide position and the jammed sheet removing position.

2. The image forming apparatus according to claim 1, wherein said opening and shutting mechanism further comprises:

a swingable lever mounted on a rotating shaft;

a pressing arm for contacting one of said swingable guide plates, said pressing arm being fixed on the same rotating shaft; and a pressing cam for pushing said swingable lever, said pressing arm being mounted on said reverse unit;

wherein said swingable guide plates are at the sheet guide position when said pressing arm is pressed by said pressing cam, and said swingable guide plates are at a jammed sheet removing position when said pressing arm is not pressed by said pressing cam.

3. The image forming apparatus according to claim 2, wherein said swingable lever is mounted at an approximately central position in a longitudinal direction of the rotating shaft.

4. The image forming apparatus according to claim 1, wherein said reverse unit is slidably mounted on a main body, and said pressing cam is positioned such that pressure on said swingable lever by said pressing cam is released by any movement of said reverse unit from a fully installed position within the main body.

5. The image forming apparatus according to claim 1, further comprising:

at least one roller pair mounted on said swingable guide plates, each of said at least one roller pair forming a nip when said swingable guide plates are in said sheet guide position for advancing the sheet through one of said sheet conveying paths, and wherein pressure at the nip of said at least one roller pair is released when said swingable guide plates are in said jammed sheet removing position so as to permit removal of the jammed sheet.

6. The image forming apparatus according to claim 1, further comprising:

means, mounted on said swingable guide plates, for forming a nip when said swingable guide plates are in said sheet guide position for advancing the sheet through one of said sheet conveying paths, and means for eliminating pressure at the nip when said swingable guide plates are in said jammed sheet removing position so as to permit removal of the jammed sheet.

7. An image forming apparatus having a plurality of parallel mounted sheet conveying paths, comprising:

means for forming an image and transferring the image to a sheet;

a plurality of shafts carried by the forming means;

movable reversing means, positioned adjacent the sheet conveying paths, for reversing a direction of movement of the sheet;

at least two swingable guide plates defining the plurality of parallel mounted sheet conveying paths and being swingably mounted on said shafts for movement between a sheet guide position in which said swingable guide plates are able to guide a sheet along said sheet conveying paths, and a jammed sheet removing position in which said sheet conveying paths are opened and accessible for removal of a jammed sheet; and opening and shutting means for causing said swingable guide plates to move about said shafts between the sheet guide position and the jammed sheet removing position.

8. The image forming apparatus according to claim 7, wherein said opening and shutting means further comprises:

a swingable lever mounted on a rotating shaft;

a pressing arm for contacting one of said swingable guide plates, said pressing arm being fixed on the same rotating shaft; and a pressing cam, mounted on said reversing means, for pushing said swingable lever;

wherein said swingable guide plates are at the sheet guide position when said pressing arm is pressed by said pressing cam, and said swingable guide plates are at a jammed sheet removing position when said pressing arm is not pressed by said pressing cam.

9. The image forming apparatus according to claim 8, wherein said swingable lever is mounted at an approximately central position in a longitudinal direction of the rotating shaft.

10. The image forming apparatus according to claim 7, wherein said reversing means is slidably mounted on a main body, and said pressing cam is positioned such that pressure on said swingable lever by said pressing cam is released by any movement of said reversing means from a fully installed position within the main body.

11. A method for removing a jammed sheet in an image forming apparatus having a plurality of parallel mounted sheet conveying paths and comprising an image forming portion which transfers an image to a sheet; a movable reverse unit positioned adjacent the sheet conveying paths, for reversing a direction of movement of the sheet; at least two swingable guide plates defining the plurality of parallel mounted sheet conveying paths and being swingably mounted for movement between a sheet guide position in which said swingable guide plates are able to guide the sheet along said sheet conveying paths, and a jammed sheet removing position in which said sheet conveying paths are opened and accessible for removal of a jammed sheet; and an opening and shutting mechanism for causing said swingable guide plates to move between the sheet guide position and the jammed sheet removing position, comprising the steps of:

pulling out the reverse unit;

moving said swingable guide plates to the jammed sheet removing position; and removing the jammed sheet from at least one of the plurality of sheet conveying paths.

* * * * *